US005433048A

United States Patent [19]

Strasser

[11] Patent Number: 5,433,048

[45] Date of Patent: Jul. 18, 1995

[54] MOLDING OF SYNTHETIC RESIN FOAM WITH HIDDEN FITTINGS

[75] Inventor: Jean P. Strasser, Aachen, Germany

[73] Assignee: NMC S.A., Belgium

[21] Appl. No.: 120,326

[22] Filed: Sep. 14, 1993

Related U.S. Application Data

[63] Continuation of Ser. No. 755,807, Sep. 6, 1991, abandoned.

[30] Foreign Application Priority Data

Sep. 23, 1990 [DE] Germany ..... 40 30 117.6

[51] Int. Cl.[6] ..... E04F 19/04

[52] U.S. Cl. ..... 52/288.1; 52/506.07

[58] Field of Search ..... 52/287, 288, 718.04, 52/718.05, 718.06, 484, 506.07, 506.08

[56] References Cited

U.S. PATENT DOCUMENTS

| | | | |
|---|---|---|---|
| 308,312 | 11/1884 | Gardner | 52/716 |
| 2,981,988 | 5/1961 | Schweitzer | 52/288 |
| 3,302,350 | 2/1967 | Brown et al. | 52/718.1 X |
| 3,668,826 | 6/1972 | White | 52/484 X |
| 3,685,235 | 8/1972 | Lang | 52/484 X |
| 3,685,238 | 8/1972 | Fisher | 52/484 X |
| 3,707,061 | 12/1972 | Collette | 52/717.1 X |
| 3,782,054 | 1/1974 | Goss | 52/656.9 X |
| 3,899,258 | 8/1975 | Matthews | 52/656.9 X |
| 4,091,586 | 5/1978 | Schwartz | 52/716 X |
| 4,150,517 | 4/1979 | Warner | 52/288 |
| 4,175,360 | 11/1979 | Mulvey | 52/506.08 X |
| 4,651,482 | 3/1987 | Borys | 52/656.9 X |
| 4,783,946 | 11/1988 | Boegle | 52/484 X |
| 4,831,804 | 5/1989 | Sayer | 52/656.9 X |
| 4,926,606 | 5/1990 | Hanson | 52/506.07 |
| 4,932,170 | 6/1990 | Spear | 52/484 X |
| 5,001,877 | 3/1991 | Edwards | 52/280 X |

*Primary Examiner*—Carl D. Friedman
*Assistant Examiner*—Beth A. Aubrey
*Attorney, Agent, or Firm*—Larson and Taylor

[57] ABSTRACT

The invention provides a moulding of foam synthetic resin for hiding the angle zone between the wall and the ceiling or between the wall and the floor of a room, which to the rear has a retainer profile (7 and 8), into which the lugs (9 and 10) on the fittings (1) fit. The fittings (1) secured in the angle zone between the wall and the ceiling thus bear the moulding (2) and the arrangement in accordance with the invention consisting of the moulding (2) and the fittings (1) may also constitute the border of a suspended ceiling adjacent to the walls and in this respect simultaneously perform a load bearing function as regards the ceiling edge elements of the suspended ceiling. The suspended ceiling may be a coffered ceiling, whose coffer frame are constituted by the mouldings (2). The angles constituted by two respective mouldings of a coffer frame are held together by means of angle fittings or, respectively, resilient staples.

15 Claims, 9 Drawing Sheets

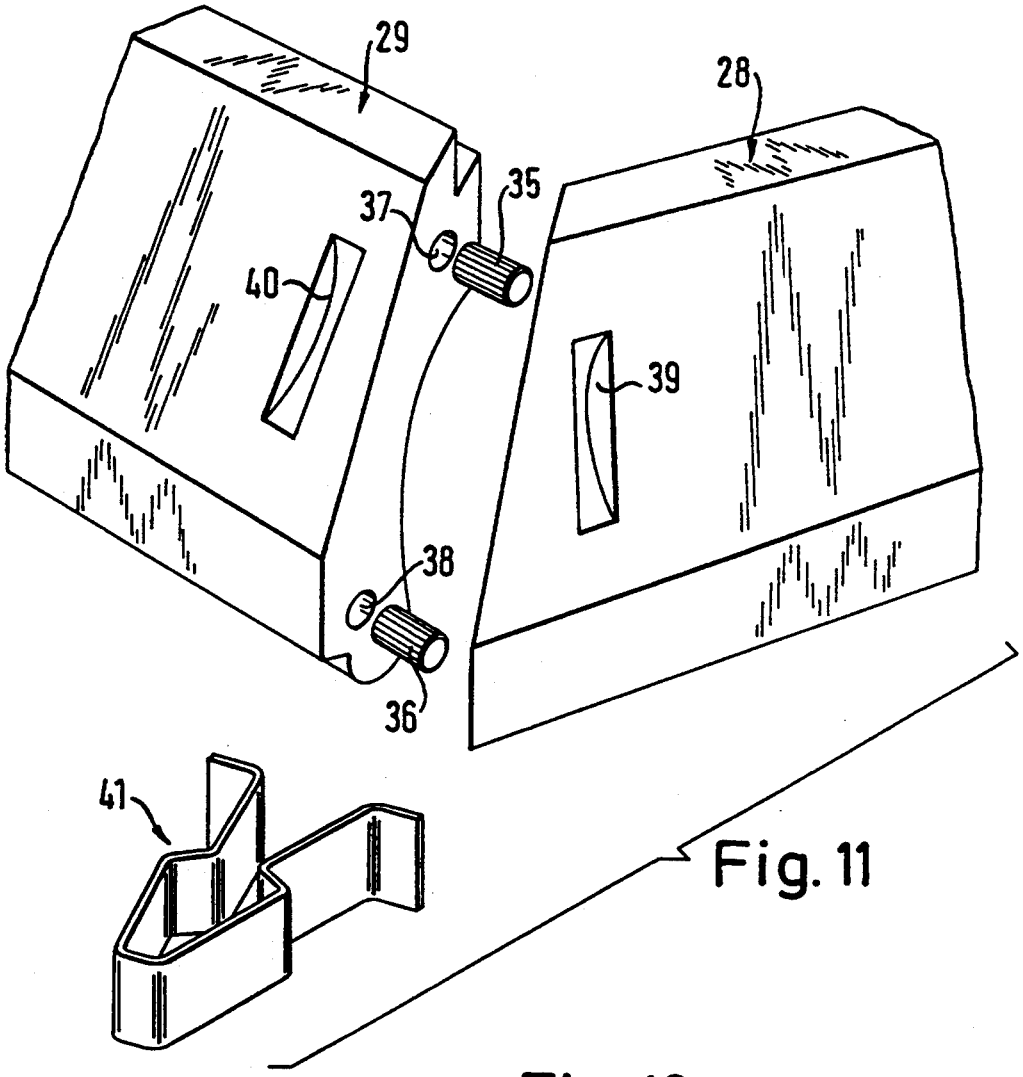
Fig. 11
Fig. 12
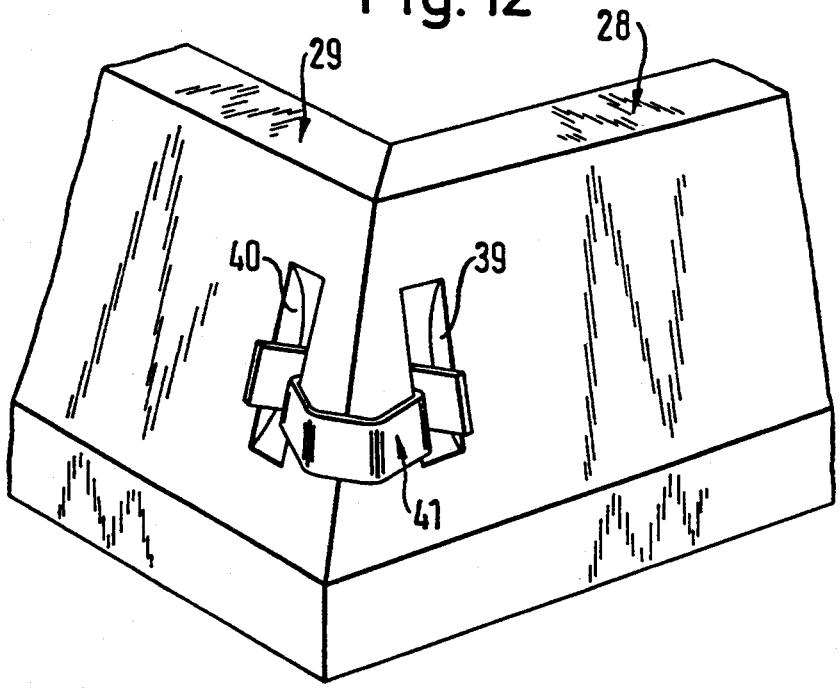

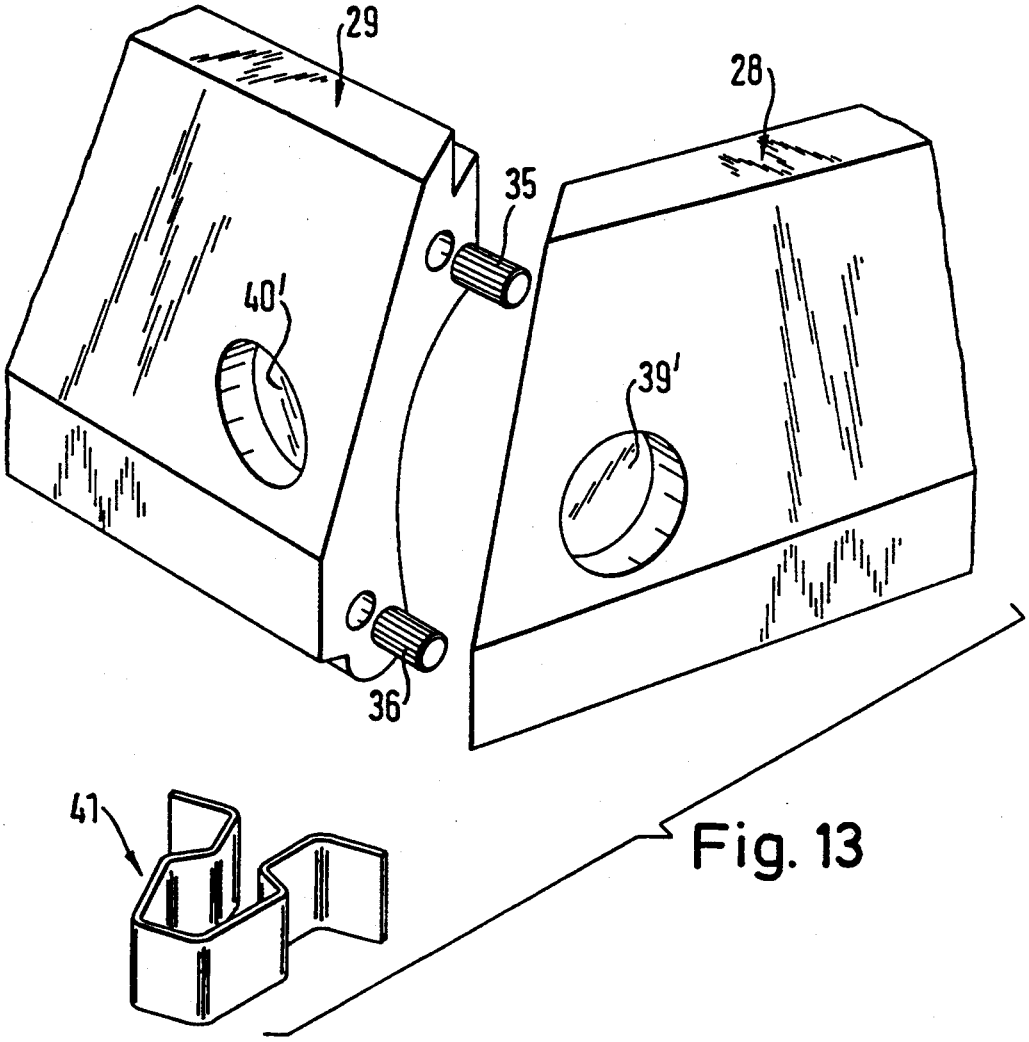
Fig. 13
Fig. 14
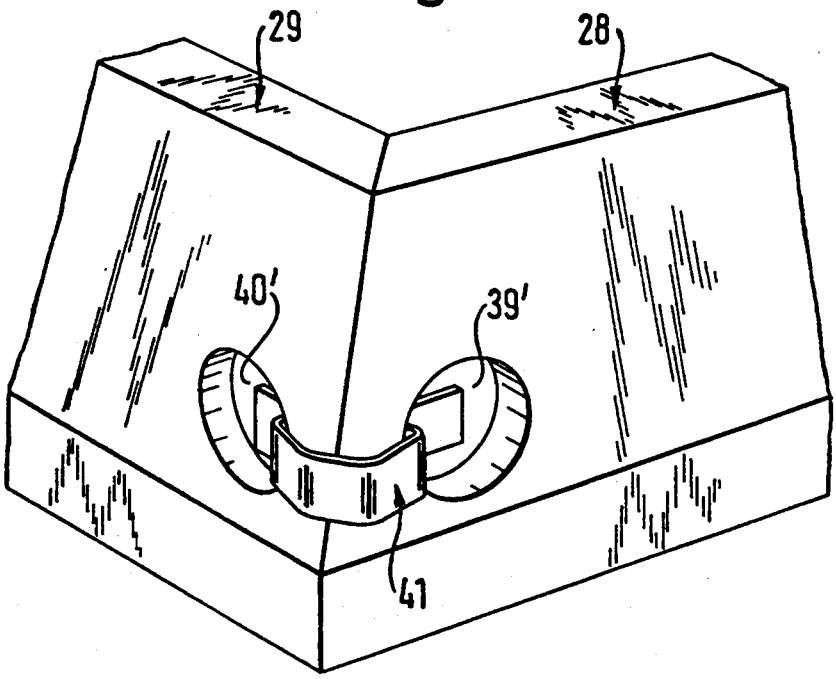

MOLDING OF SYNTHETIC RESIN FOAM WITH HIDDEN FITTINGS

This application is a continuation of application Ser. No. 07/755,807 filed Sep. 6, 1991.

The present invention relates to a moulding of foam material as a cover for an angle between a wall and a ceiling or, respectively, between the wall and the floor of a room and/or for covering a ceiling.

Mouldings of foam synthetic resin have been previously proposed in the form of decorative strips used in the angle between a wall and the ceiling or, respectively, between the wall and the floor and are bonded to the wall and/or to the ceiling or, respectively, the floor.

The bonding of decorative mouldings is complex and may only be performed by trained operators to be satisfactory. In this respect the possibilities for bonding decorative mouldings are limited, if they are to constitute the terminal skirting of suspended ceilings, as for instance in the case of a coffered ceiling.

One object of the invention is hence to provide a moulding of foam synthetic resin for covering the abutment zone between the wall and the ceiling or between the wall and the floor of a room which is able to be rapidly and easily attached to the abutment zone without trained assistance. A still further object of the invention is provide such a moulding which makes it possible to greatly simplify difficult bonding techniques.

In order to achieve these and/or other objects the moulding is supported by hidden fittings, which are mounted in the abutment zone.

In the case of one advantageous embodiment the back side of the moulding has a mounting profile adapted to the fitting. In this respect the mounting profile may have at least one recess, into which a projecting part on the fitting is adapted to non-positively fit.

It is an advantage in this case if the recess is constituted by a groove. The mounting profile on the rear side of the moulding may furthermore be constituted by a first longitudinal groove adjacent to the top rear edge of the moulding and a parallel second longitudinal groove adjacent to a lower rear edge of the moulding, both grooves extending along the full length of the moulding and on its upper and lower ends the fitting has a respective lutag-like projecting part, which fits into the grooves. Furthermore, it may be an advantage for the mounting profile of the moulding to be constituted by two wedge-like notches between which a dovetail section of the moulding is formed, which fits into a free space in the fitting between two lip-like projecting parts of the fitting, which are resilient.

Rapid and simple mounting of a moulding in accordance with the invention is possible more particularly if the mounting profile of the moulding constitutes a detent or clamping connection for the fitting.

In the case of a advantageous further working embodiment of the invention at least one poising fitting is provided on the rear side of the moulding, which cooperates with the fitting in the abutment zone between the wall and the ceiling or, respectively, between the wall and the floor in constituting a detent or clamping connection. In this respect it is possible for the mating fitting to be screwed of pinned to the rear side of the moulding.

Furthermore it is also an advantage if the mating fitting consists of a base plate, which is attached to the rear side of the moulding and has a dagger-like projecting part with a resilient notch, which together with one projecting part of the fitting constitutes a gripping connections. Moreover it may be an advantage if the moulding is designed in the form of an angle moulding, whose one flange part is attached to the wall and whose other flange part, which freely projects into the room, fits into the notch in the dagger-like projecting part on the profile-fitting with a non-positive linking effect.

The moulding and/or the fitting may also form a support surface or ledge for a suspended ceiling cladding. In this case it is possible for the moulding to constitute the outer edge rail of a coffered ceiling, which is then supported oil the edge rail.

The fittings for mounting the mouldings in accordance with the invention in the abutment zone between the wall and the ceiling and, respectively, between the wall and the floor and furthermore the fittings for the assembly of the coffer frame in accordance with the invention from the mouldings may consist of metal or synthetic resin. Preferably, the fittings consist of a resilient and suitably angled piece of sheet metal or of an extruded resilient synthetic resin moulding. In the case of this preferred resilient embodiment of the invention of the fittings there is inter alia the advantage that owing to the clamping effect due to the resilient force the mouldings are securely seated on the fitting and if necessary are pressed against the ceiling support so that any unevenness of the ceiling may be allowed for.

The invention is not limited to a moulding foam synthetic resin for covering over the abutment zone between the wall and the ceiling or a room. In fact a moulding of foam synthetic resin may in accordance with the invention be used also for cladding a ceiling if a plurality of identical mouldings are put together like a frame to constitute a single coffer as a component of a coffered ceiling and at the outer side at two respectively abutting mouldings all angle fitting is used to form a single coffer. The angle fitting may be in the form of an angle fitting or a spring staple, the angle fitting being received in recesses which are external in relation to the complete coffer, in the abutting mouldings.

The invention will now be described in the working embodiments, which are illustrated diagrammatically in the accompanying figures in which like parts are denoted by like reference characters.

FIG. 11 is a perspective view of two mouldings constituting a further coffer in accordance with the invention prior to the assembly thereof with a respective angle fitting.

FIG. 12 shows the moulding in accordance with FIG. 11 after assembly thereof.

FIG. 13 is a perspective view of two mouldings forming an angle of a still further coffer in accordance with the invention prior to its assembly with the associated coffer fitting.

FIG. 14 shows moulding in accordance with 13 after the assembly thereof.

Figure 1:
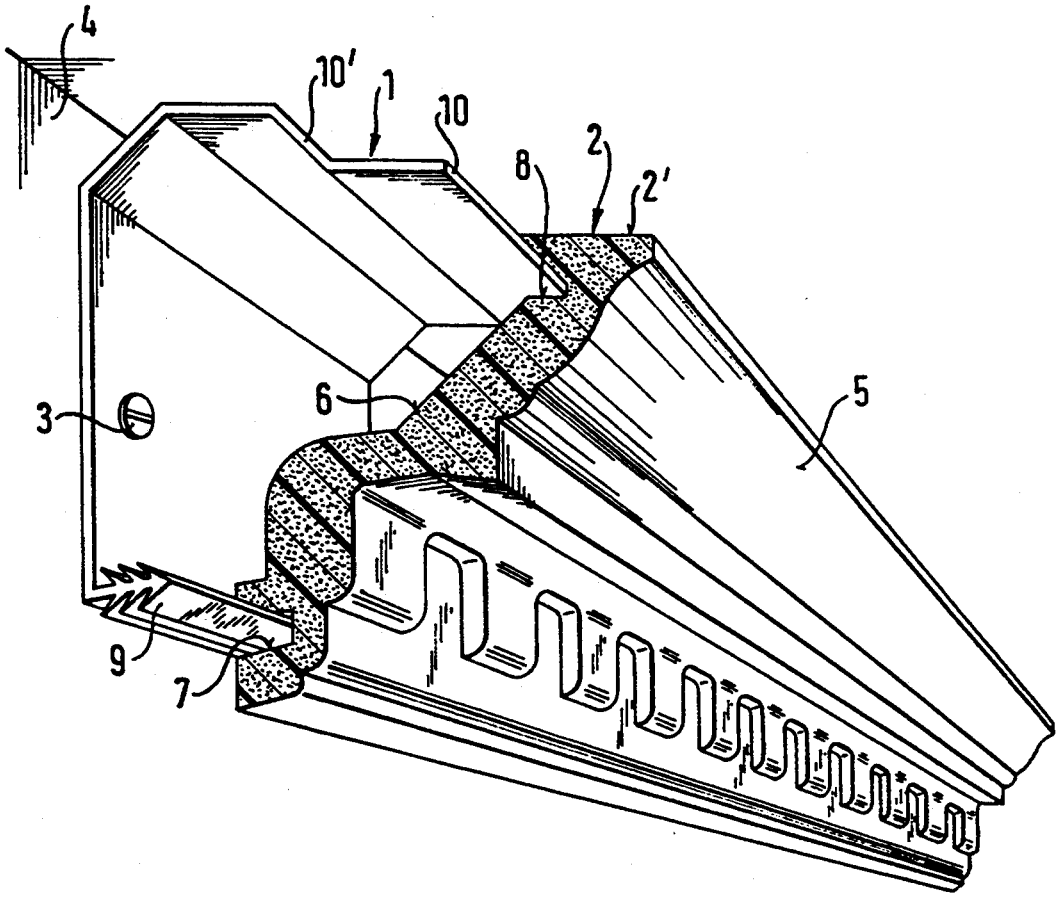
FIG. 1 is a perspective view of a first working embodiment of moulding in accordance with the invention with the fitting for attachment in the abutment zone between the wall and the ceiling of a room.

In FIG. 1 the moulding in accordance with the invention is referenced 2 and it is held by the fittings 1, which in the abutment zone between a vertical wall and a horizontal ceiling will be seen to be held by nails, screws or other fastening means, of which one is illustrated in FIG. 1 only in the form of a nail head.

The moulding has a decorative profile 5, whose design is only illustrated as one possible example, on its front side. On the rear side 6 the moulding has a mounting profile, which in this present example consists of parallel longitudinal grooves 7 and 8, into which the lugs 9 and 10 of the fitting 1 extend.

In accordance with FIG. 1 the upper moulding is smooth on both sides and fits into the longitudinal groove 8 in a non-positive manner, for which purpose the width and the depth of the longitudinal groove and suitably adapted to the breadth and the thickness of the lug 10.

The lower lug 9 has a profile which in cross section is similar to a fishbone or christmas tree, the oblique surfaces placed under each other being able to be pressed out of an initial position elastically inwards. The christmas tree profile of the lug 9 fits with an elastic loading effect into the groove 7 of the moulding 5, whose width is somewhat smaller than the width of the christmas tree profile in its unstressed initial position.

It will be clear to the man in the art that both the lugs 9 and 10 may have a christmas tree profile or both lugs 9 and 10 may have a smooth profile. The invention is not limited to the working embodiment, in which only two possible types of lugs are illustrated, which fit into the longitudinal grooves 7 and 8 of the moulding in order to bear it. The man in the art will further be aware that possibly even one single lug on the fitting 1 might be sufficient for mounting one moulding 2 which fits into a suitable groove of the moulding 2.

It is an advantage if the rear mounting profile of the moulding has continuous longitudinal grooves 7 and 8.

Figure 2:
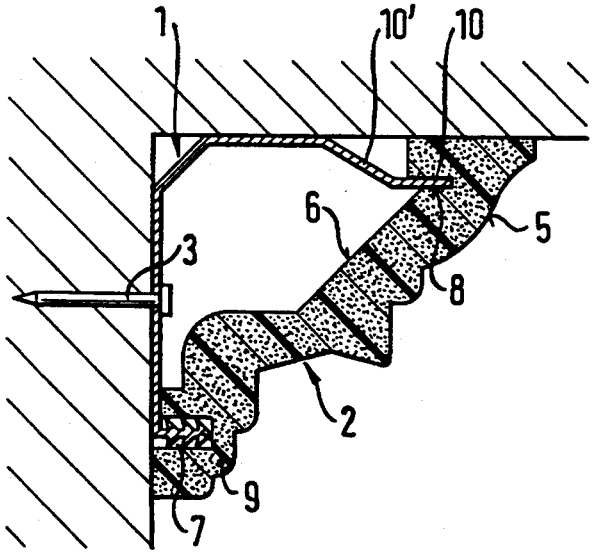
FIG. 2 is cross section taken through a mounted moulding as in FIG. 1 and the abutment zone, at which it is held.

FIG. 2 shows that the upper rail 10 of the fitting 1 has the particular feature that it not only has a bearer function with respect to the moulding but also an abutment function. The lug 10 and the adjacent wall parts 10' are so designed like springs that after the insertion of the lug 10 into the groove 8 the moulding 2 is pressed with its flat upper end surface elastically against the ceiling. In the mounted condition of the moulding 2 the lug 10 of the fitting 1 is pressed somewhat downwards elastically.

Figure 3:
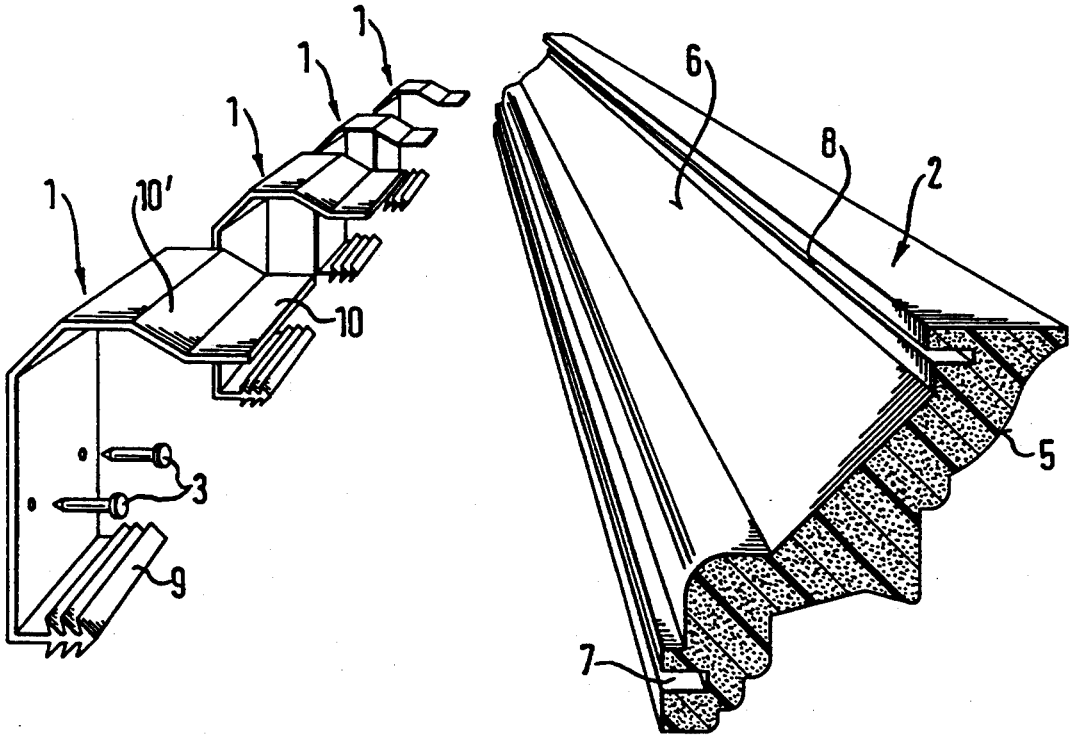
FIG. 3 shows the moulding in accordance with FIG. 1 in a perspective rear view prior to mounting on the fittings.

FIG. 3 shows a moulding 2 which is drawn in a perspective view as seen from the back, with the two open grooves 7 and 8. The individual fittings, which are identical in design, are secured to the vertical wall, for instance by means such as nails or screws 3. In order to hold the moulding 2 on the individual fittings 1 the lugs 9 and 10 correspondingly fit into the grooves 7 and 8 of the moulding 2 as shown in FIG. 1.

Figure 4:
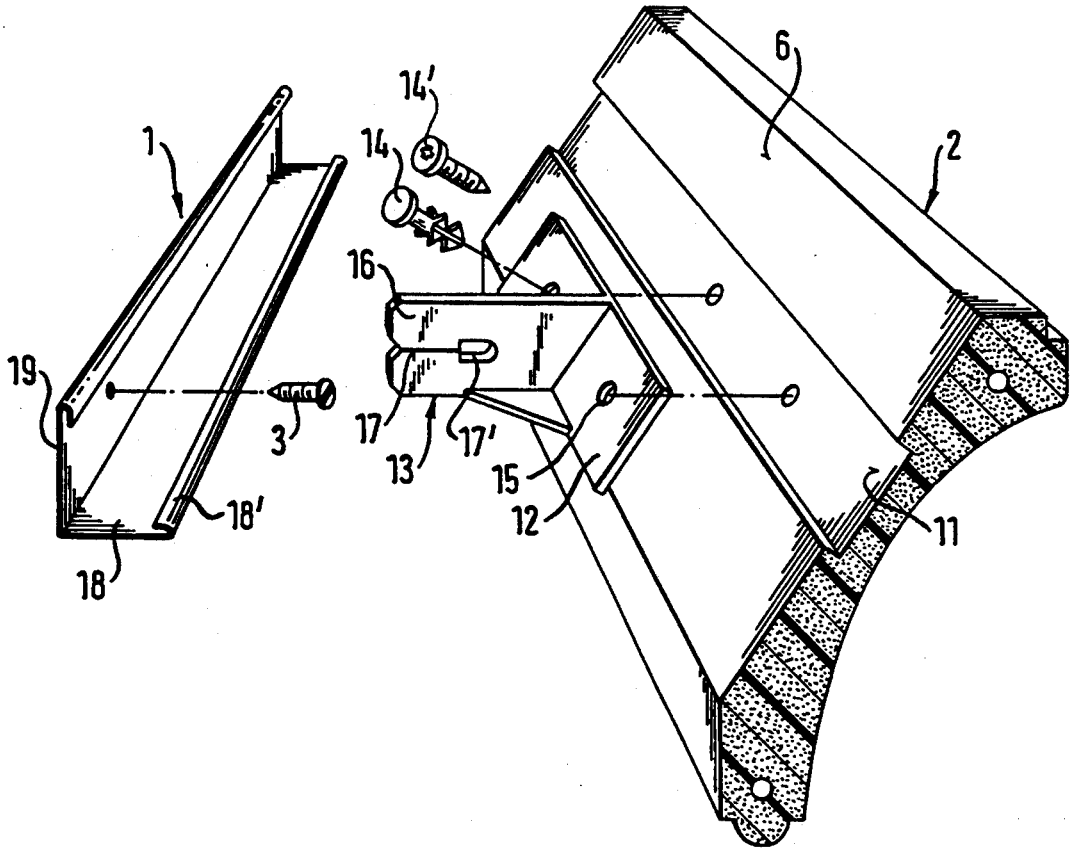
FIG. 4 is a perspective view of a second working embodiment of the moulding in accordance with the invention prior to its mounting on a single-piece fitting.

FIG. 4 shows a further moulding 2 in accordance with the invention in a perspective view as seen from the rear. The rear side 6 of the moulding 2 possesses a shallow longitudinal groove 11 into which the base plate 12 of one or more fittings 13 fits, which may be held by means of screws 14 or 14' on the moulding 2, which extend through holes 15 in the base plate. A dagger 16 extends freely to the outside from the base plate 12 and it has a resilient notch 17 into which there fits the Fail part 18, projecting from the wall, of a fitting 1 designed in the form of an angle rail and whose other rail part 19, which extends parallel to the wall, is held on the wall by means of nails or screws. The thickness of the projecting rail part 18 is so selected that it fits with a squeezing loading effect into the slot 17 of the mating fitting 13 in order to hold the moulding 2 on the wall in the predetermined position. The rail part 18 in this case advantageously has a thicker part on its front edge 18', which snaps into the wider part 17' of the gap 17 at the rear end thereof, the moulding 2 then being in the desired position on the wall.

The fitting 1 may be so secured to the wall that the moulding 2, which is held by the fitting, has its upper edge bearing against the ceiling.

Figure 5:
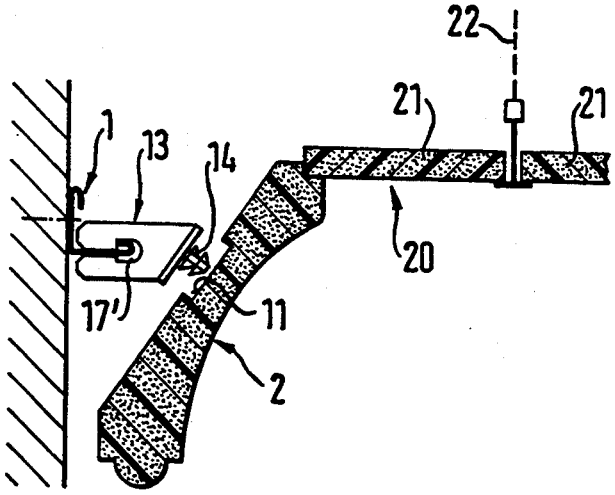
FIG. 5 shows a cross section taken through the moulding in accordance with FIG. 4 as an edge rail for a suspended ceiling.

In FIG. 5 a suspended ceiling 20 is indicated in cross section, in the case of which the terminal edge rail is constituted by the moulding 1, which bears a horizontal ceiling section 21, which in a known manner is suspended from the ceiling as such by means of a suspending device 22. In FIG. 5 the mating fitting 13 on the fitting 1 is illustrated after being detached from the moulding 2.

Figure 6:
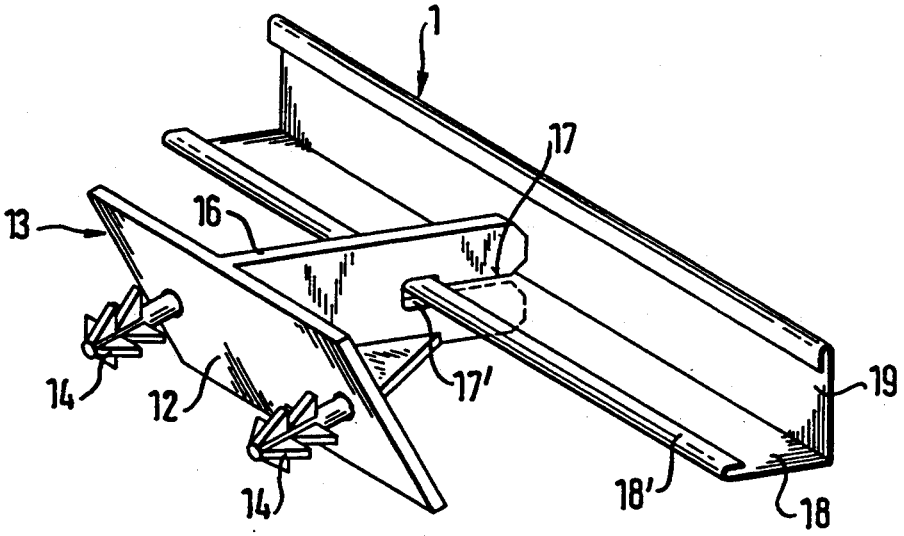
FIG. 6 is a perspective view of a fitting in accordance with FIG. 4 in conjunction with an angled fitting for holding the moulding in accordance with FIG. 4.

FIG. 6 shows the mating fitting 13 in the clamped position on the fitting 1 on an enlarged scale. Fastening means 14 extend through the base plate 12 of the mating fitting 13 and they have a christmas tree configuration and they are pressed into the moulding in order to connect it to the mating fitting 13 which for its part is slipped over the rail part 18 of the fitting.

Figure 7:
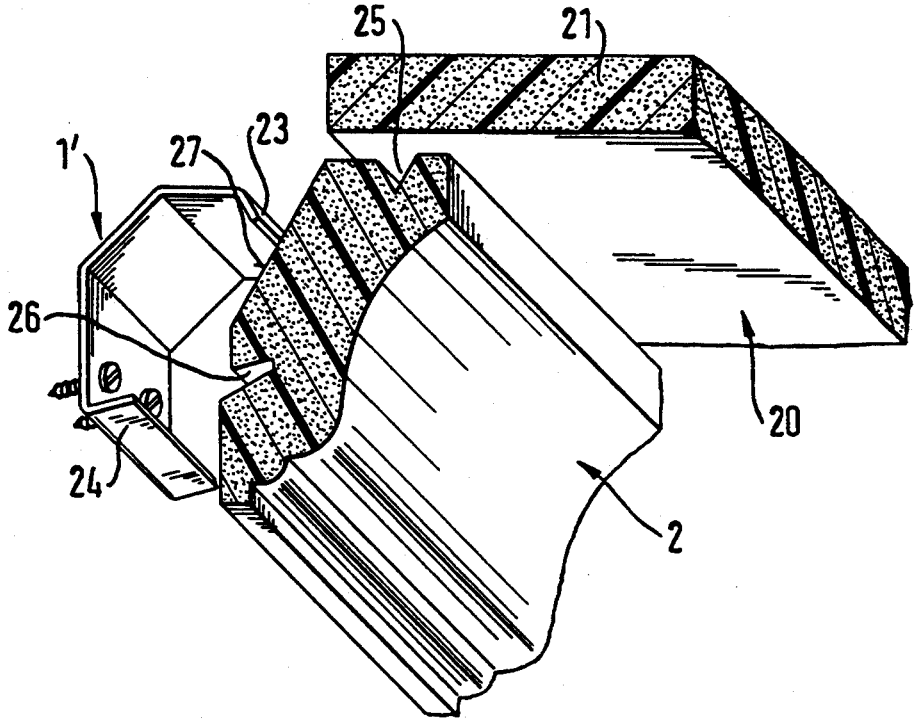
FIG. 7 is a perspective view of a third working embodiment of the moulding in accordance with the invention as an edge rail for a suspended ceiling prior to mounting of the moulding on a fitting.

FIG. 7 shows a further moulding 2 in accordance with the invention, which has notches 25 and 26 on the rear side delimiting a dovetail middle profile part 27 on the rear side of the moulding. This dovetail middle profile part 27 fits into the free space in the fitting 1', which at its top and lower ends has lugs 23 and 24, which snap into the notches 25 and 26 in order to hold the moulding on the fitting. The lugs 25 and 26 have to be of elastic design so that between the fitting 1' and the moulding 2 it is possible to produce a snap or detent connection. In order to mount a long moulding 2 a corresponding number of fittings 1' will be present, which are flush like the fittings 1 in FIG. 3. The fitting(s) 1' is or are so arranged spaced from the ceiling that one ceiling part 21 of a suspended ceiling may rest on the upper edge of the moulding, which therefore constitutes an edge rail of the suspended ceiling. In this case it may for instance be a question of a suspended coffered ceiling.

Figure 8:
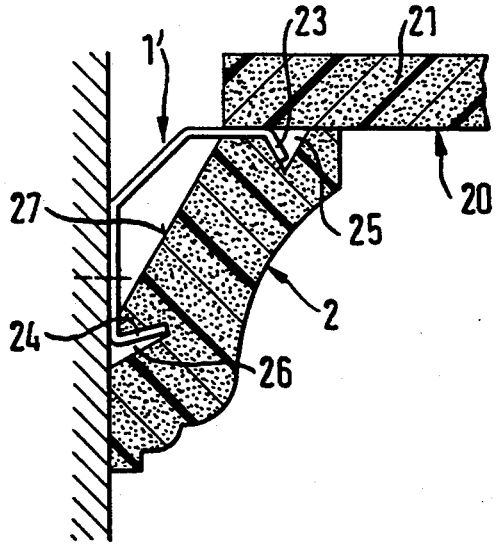
FIG. 8 shows a cross section taken through the mounted moulding in accordance with FIG. 7.

FIG. 8 shows a cross section taken through the moulding 2, which is held by the fitting 1', in accordance with FIG. 7 with the ceiling part 21, which here rests on the upper edge of the moulding 2 and simultaneously on the flat upper end of the fitting 1', there being, as noted, a plurality thereof arranged flush in a row.

The invention is not limited to a moulding of foam synthetic resin for an angle zone between a wall and a ceiling or the wall and the floor of a room. In fact in accordance with the invention a moulding may also be so designed that it is suitable for forming coffer frames for a coffered ceiling. In this respect there is the possibility in accordance with the invention of using one and the same type of moulding for covering over the angle between the wall and the suspended ceiling and also for constituting the coffer frame.

Prior art suspended coffered ceilings suffer from the disadvantage that the coffers are not constituted by such mouldings as are also suitable for covering over the angle zone between the wall and the ceiling and are consequently able to serve as edge mouldings or strips for a coffered ceiling.

FIGS. 9 through 14 show working embodiments of the design of a coffer as a component for a suspended ceiling.

Figure 9:
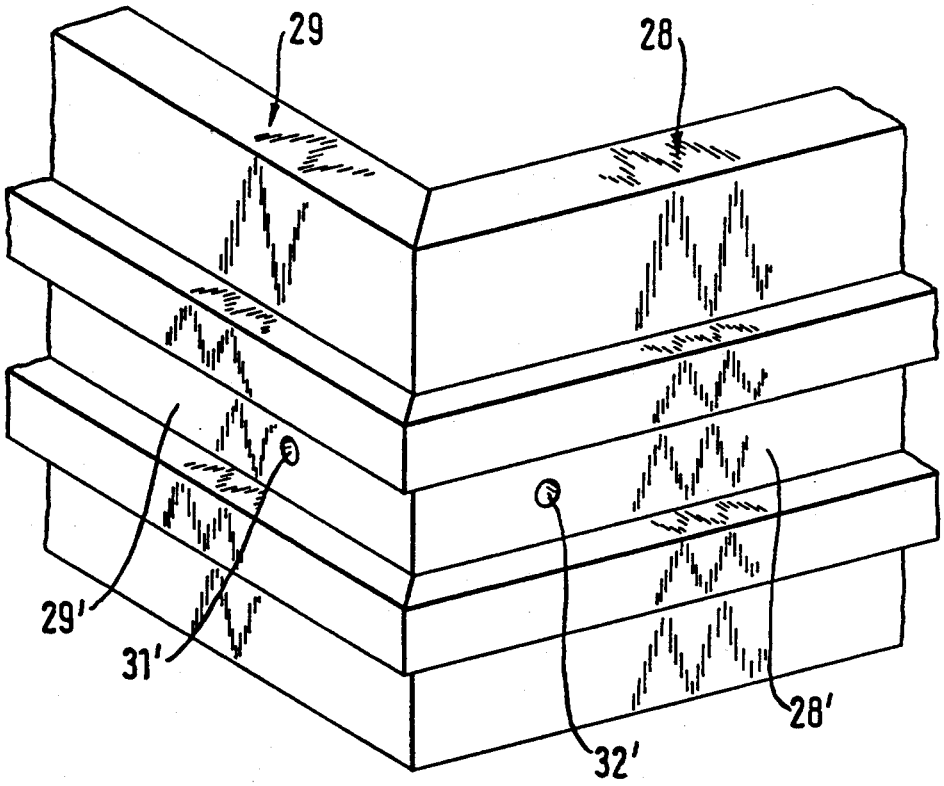
FIG. 9 is a perspective view of two moulding sections in order to form a coffer in accordance with the invention for a coffered ceiling in a first working embodiment thereof.

FIG. 9 shows two mitered moulding sections 28 and 29 of a coffered ceiling.

Figure 10:
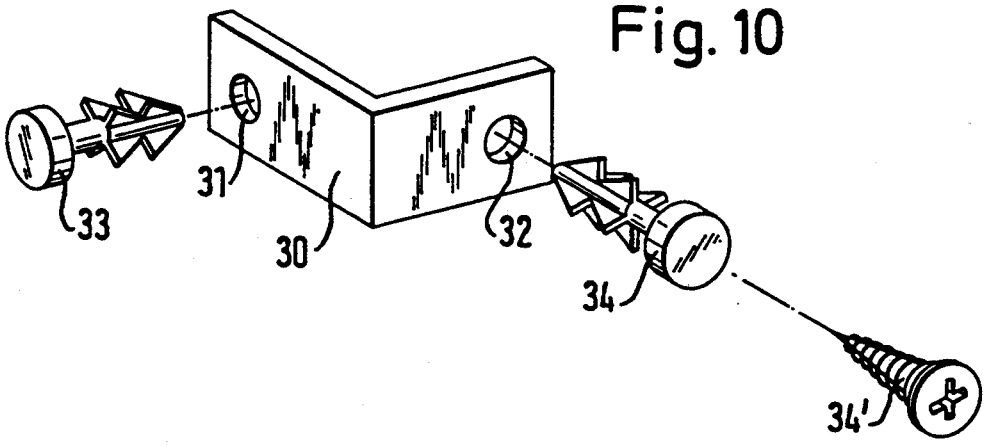
FIG. 10 is a perspective representation of an angle fitting for the angle connection of the mouldings.

FIG. 10 shows an angle fitting 30 for the assembly of the coffered ceiling in accordance with FIG. 9. The angle fitting has holes 31 and 32, through which expansion plugs 33 and 34 or screws 34' extend. The angle fitting is received in grooves 28' and 29' in the outer surface of the mouldings 28 and 29. The expansion plugs or, respectively, screws 33 and 34 or 34' are fitted in prepared holes 31 and 32 in order to hold the two mouldings 28 and 29 together.

FIGS. 11 and 12 show two further miter-cut mouldings 28 and 29, which are joined by plugs 35 and 36 together in order to form a coffer frame which plugs fit into holes 37 and 38 at the end surface of the mouldings 28 and 29.

The mouldings 28 and 29 have two recesses 39 and 40 on the outside adjacent to the angle constituted by them in order to receive the legs of a spring staple 41 with a snap-in action in order to in this manner to rapidly form a secure angle connection.

FIGS. 13 and 14 show two further mouldings 28 and 29 similar to that of FIG. 11 in the condition ready for fitting and in the fitted condition. The difference from FIG. 11 is that on the outside the mouldings 28 and 29 have round recesses 39' and 40', into which the two legs of the resilient staple 41 may be fitted in order to produce an angle connection.

Figure 15:
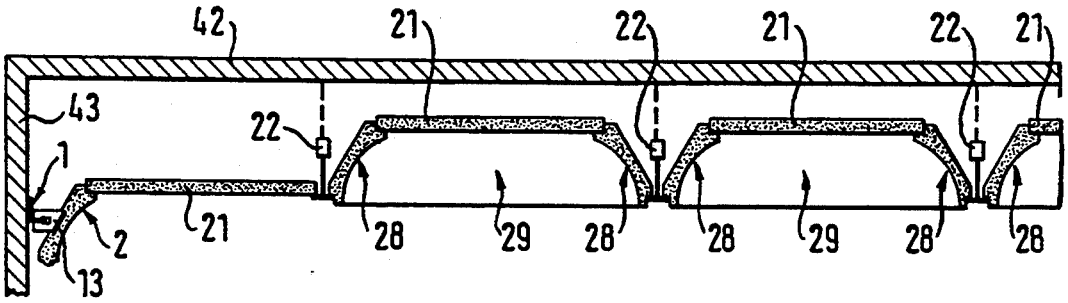
FIG. 15 shows a cross section taken through a ceiling and a wall section with a moulding in accordance with the invention and an adjacent coffered ceiling in accordance with the invention.

FIG. 15 shows a section taken through a ceiling 42 and a wall 43. A coffered ceiling in accordance with the invention is suspended in a conventional manner from the ceiling 42. The coffered ceiling adjoins the wall 43 via a separate covering plate 21 using the moulding 2 in accordance with the invention and suitable fittings.

Figure 16:
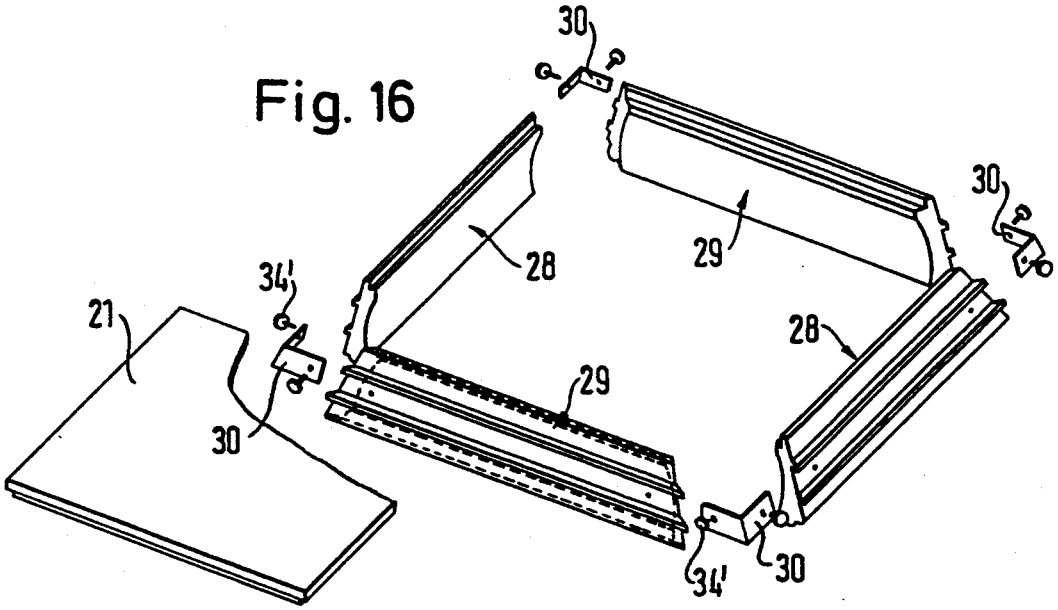
FIG. 16 shows a perspective view of four mouldings constituting a coffer in accordance with the invention prior to their assembly.
Figure 17:
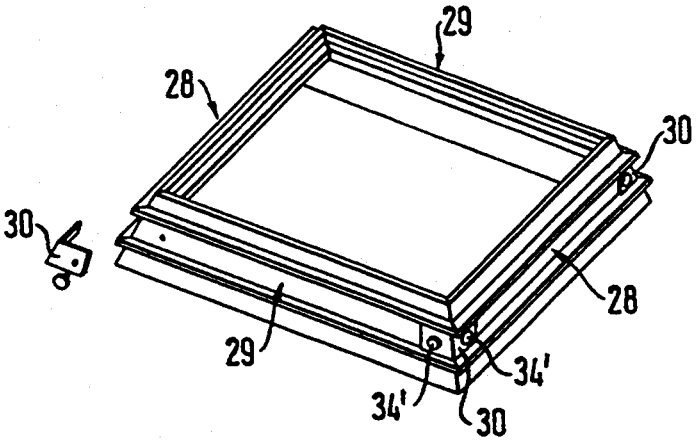
FIG. 17 shows the partly assembled mouldings in accordance with FIG. 16 with an associated angle fittings prior to their assembly.

FIGS. 16 and 17 illustrate a coffer frame in accordance with the invention for such a coffered ceiling, which in this case consists of four miter-cut mouldings 28, 28, 29 and 29 (see FIGS. 16 and 17) which are combined to constitute a coffer frame (see FIG. 17). The coffer frame is held together at the outer angles by means of fittings 30 with screws 34', as described in the above with reference to FIGS. 9 and 10. The open coffer frame is covered over by a cover plate 21. The completed individual coffers come to rest on the battens 22 which are provided with attachment devices and constitute a support grating which is secured to the ceiling. Such suspended ceilings are inherently known in the art.

The invention is not limited to the above described working embodiments and in fact the man in the art will be aware of many possible modifications without leaving the scope of the invention.

I claim:

1. A suspended coffered ceiling comprising:

(a) open coffer frames;

(b) bearer ledges for covering an angle zone formed by the intersection of a wall and the suspended coffered ceiling;

(c) covering plates for covering said open coffer frames and for covering an open area between said coffer frames and said bearer ledges; and (d) fittings secured in an angle zone between the wall and the suspended coffered ceiling for supporting the bearer ledges, said coffer frames and bearer ledges comprising identical moldings, each of said moldings having the same shape and identical cross-sectional shape taken along a length thereof.

2. The suspended coffered ceiling according to claim 1, wherein adjacent corners of the coffer frames are held together by angle fittings or resilient staples.

3. The suspended coffered ceiling according to claim 1 wherein said identical moldings comprise a retainer profile on one side thereof, said retainer profile being adapted to the fittings.

4. The suspended coffered ceiling according to claim 3 wherein the retainer profile comprises at least one recess adapted to receive the fittings.

5. The suspended coffered ceiling according to claim 4 wherein the top edge of each of the identical moldings includes a recess therein, the recess in said top edge and the recess in said retainer profile defining a dovetail profile section between them which fits between two supporting parts of the fitting.

6. The suspended coffered ceiling according to claim 4 wherein the retainer profile of the molding comprises a snap-connection or a clamping connection with the fitting, whereby the molding is completely removable from and reattachable to the fitting.

7. The suspended coffered ceiling according to claim 4 wherein the recess comprises a groove.

8. The suspended coffered ceiling according to claim 7 wherein the retainer profile comprises a first longitudinal groove adjacent to an upper edge of the molding and a parallel second longitudinal groove adjacent to a lower edge of the molding, the two grooves extending into a full length of the molding, the supporting parts of the fitting being located in said groove.

9. The suspended coffered ceiling according to claim 7 wherein the supporting parts are resiliently elastic.

10. The suspended coffered ceiling according to claim 1 further comprising at least one fitting arranged on a backside of each of the moldings, said fitting comprising a snap-connection or a clamping connection with the fittings in an angle zone between the wall and the ceiling, whereby the molding is completely removable from and reattachable to the fittings in the angle zone.

11. The suspended coffered ceiling according to claim 10 wherein the additional fitting is screwed or pinned to the backside of the molding.

12. The suspended coffered ceiling according to claim 10 wherein the additional fitting comprises a base plate, which is secured to the backside of the molding and includes a dagger-like supporting part with a resiliently elastic notch, said dagger-like support part and a part of the fitting comprising a clamping connection.

13. The suspended coffered ceiling according to claim 12 wherein the fitting comprises an angle molding which extends outward from the wall into the room and fits into the notch in the supporting part of the additional fitting.

14. The suspended coffered ceiling according to claim 1 wherein the fitting comprises resilient sheet metal or an extruded resiliently elastic synthetic resin section.

15. The suspended coffered ceiling according to claim 14 wherein the fitting comprises PVC.

* * * * *